US009165166B2

(12) United States Patent
Hamada et al.

(10) Patent No.: US 9,165,166 B2
(45) Date of Patent: Oct. 20, 2015

(54) INTERPOLATION CIRCUIT AND RECEIVING CIRCUIT

(71) Applicant: FUJITSU LIMITED, Kawasaki-shi, Kanagawa (JP)

(72) Inventors: Takayuki Hamada, Kawasaki (JP); Sanroku Tsukamoto, Setagaya (JP)

(73) Assignee: FUJITSU LIMITED, Kawasaki (JP)

( * ) Notice: Subject to any disclaimer, the term of this patent is extended or adjusted under 35 U.S.C. 154(b) by 19 days.

(21) Appl. No.: 14/179,133

(22) Filed: Feb. 12, 2014

(65) Prior Publication Data

US 2014/0320192 A1 Oct. 30, 2014

(30) Foreign Application Priority Data

Apr. 30, 2013 (JP) ..... 2013-095982

(51) Int. Cl.
*G06G 7/28* (2006.01)
*G06G 7/30* (2006.01)

(52) U.S. Cl.
CPC ..... *G06G 7/30* (2013.01)

(58) Field of Classification Search
CPC ..... G06G 7/30
USPC ..... 327/334, 231, 237, 90–94; 375/316, 375/346; 341/158, 161
See application file for complete search history.

(56) References Cited

U.S. PATENT DOCUMENTS

| | | | | |
|---|---|---|---|---|
| 8,063,811 | B2 * | 11/2011 | Hojabri et al. | 341/158 |
| 8,223,046 | B2 * | 7/2012 | Petrovic | 341/120 |
| 8,324,952 | B2 * | 12/2012 | Masters | 327/231 |
| 8,848,835 | B2 * | 9/2014 | Shibasaki | 375/316 |
| 2003/0048213 | A1 | 3/2003 | Sushihara et al. | |

FOREIGN PATENT DOCUMENTS

| | | |
|---|---|---|
| JP | 2003-158456 A | 5/2003 |
| JP | 2012-147079 A | 8/2012 |

* cited by examiner

*Primary Examiner* — Dinh Le
(74) *Attorney, Agent, or Firm* — Arent Fox LLP

(57) ABSTRACT

An interpolation circuit includes: a plurality of holding circuits configured to each hold a corresponding input data input chronologically; and a generating circuit configured to generate interpolation data by giving weights, based on an interpolation code, to input data that are chronologically adjacent to each other and are held by the plurality of holding circuits and combining the weighted data together.

16 Claims, 16 Drawing Sheets

INTERPOLATION CIRCUIT AND RECEIVING CIRCUIT

CROSS-REFERENCE TO RELATED APPLICATION

This application is based upon and claims the benefit of priority of the prior Japanese Patent Application No. 2013-095982, filed on Apr. 30, 2013, the entire contents of which are incorporated herein by reference.

FIELD

The embodiments discussed herein are related to an interpolation circuit and a receiving circuit.

BACKGROUND

The data rate at which signals are transmitted and received inside and outside apparatuses for communication basics or servers has increased. Examples of a receiving circuit of such a transmitting and receiving apparatus includes a synchronous-type receiving circuit that performs sampling synchronously with the phases of input data, and an asynchronous-type receiving circuit that performs sampling in synchronization with the phases of input data. In the asynchronous-type receiving circuit, an interpolation data is generated, using interpolation, from sampled data.

A related technique is disclosed in Japanese Laid-open Patent Publication No. 2012-147079.

SUMMARY

According to an aspect of the embodiments, an interpolation circuit includes: a plurality of holding circuits configured to each hold a corresponding input data input chronologically; and a generating circuit configured to generate interpolation data by giving weights, based on an interpolation code, to input data that are chronologically adjacent to each other and are held by the plurality of holding circuits and combining the weighted data together.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In order to generate an interpolation data, charge is accumulated in a variable capacitor included in each of a plurality of holding circuits that hold voltages of received data at different timings, and the accumulated charges are combined together. For example, when a switch that switches the capacitance value of the variable capacitor is coupled in series on a line on which a data signal is transmitted, signal loss may increase.

Figure 1:
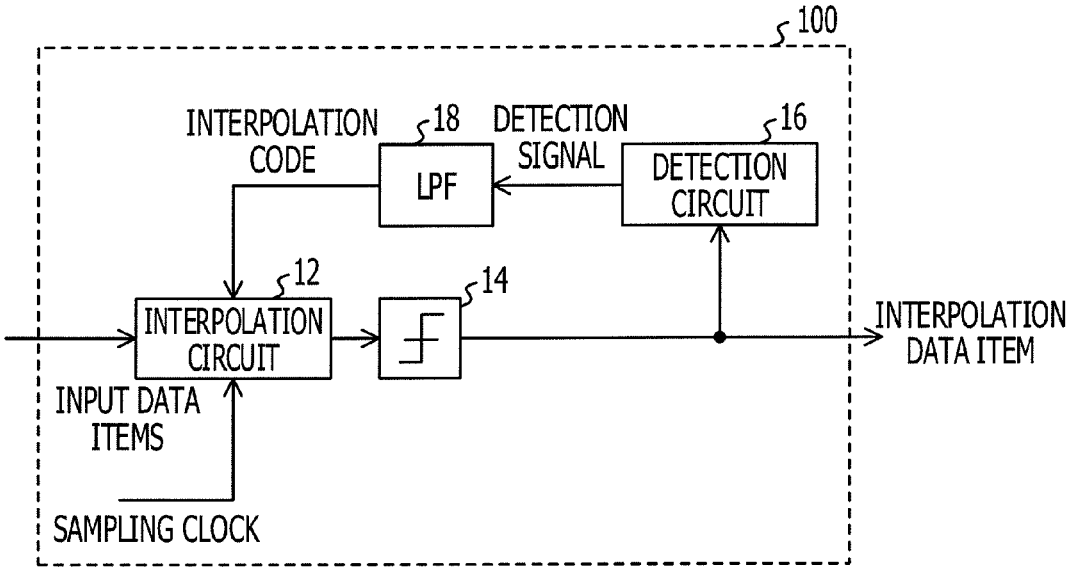
FIG. 1 illustrates an example of a receiving circuit.

FIG. 1 illustrates an example of a receiving circuit. A receiving circuit illustrated in FIG. 1 may be, for example, a receiving circuit that includes an interpolation circuit. A receiving circuit 100 includes an interpolation circuit 12, a determination circuit 14, a detection circuit 16, and a low-pass filter (LPF) 18. The interpolation circuit 12 generates, based on an interpolation code, an interpolation data from input data that include data points and boundary points and that have been chronologically input. The determination circuit 14 compares the interpolation data with a reference value, thereby determining whether the level of a voltage corresponding to the interpolation data is high or low. The determination circuit 14 generates an output data based on a result of determination. The detection circuit 16 detects the phase of the output data based on the boundary point of the output data, and outputs a detection signal. The LPF 18 performs filtering on the detection signal to obtain the interpolation code. For example, a clock data recovery (CDR) circuit may be used as the receiving circuit 100.

Figure 2:
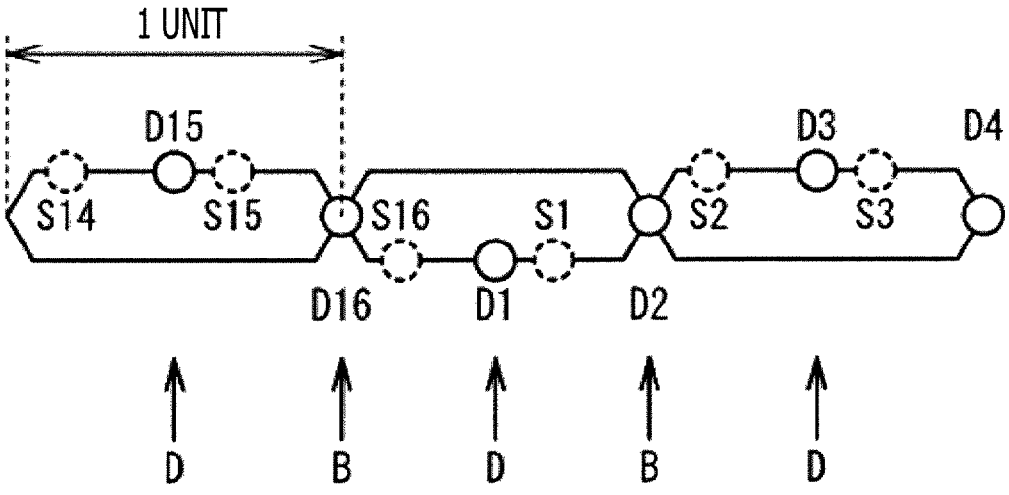
FIG. 2 illustrates an example of a signal with respect to time.

FIG. 2 illustrates an example of a signal with respect to time. For example, in a 2× system, two pieces of data are sampled in one unit interval. Another system may be applied. Sn illustrated in FIG. 2 denotes an input data that has been chronologically input. The interpolation circuit 12 generates interpolation data Dn from two pieces of input data Sn-1 and Sn (n is a natural number). In the case where an interpolation code k satisfies a relationship $0 \leq k \leq 1$, the interpolation data Dn is generated using an equation $Dn=(1-k)\times Sn-1+k\times Sn$. Thus, an interpolation data that matches the phases of the input data is generated. The interpolation code k may be a coefficient that is to be assigned, as a weight, to an input data. In the 2× system, a data point D and a boundary point B are alternately generated. The data point may be a point that is treated as a digital data in the receiving circuit and circuits following the receiving circuit. The boundary point may be a point at which a transition from data to another data occurs. In the 2× system, for example, the data point may be a midpoint between boundary points.

Figure 3:
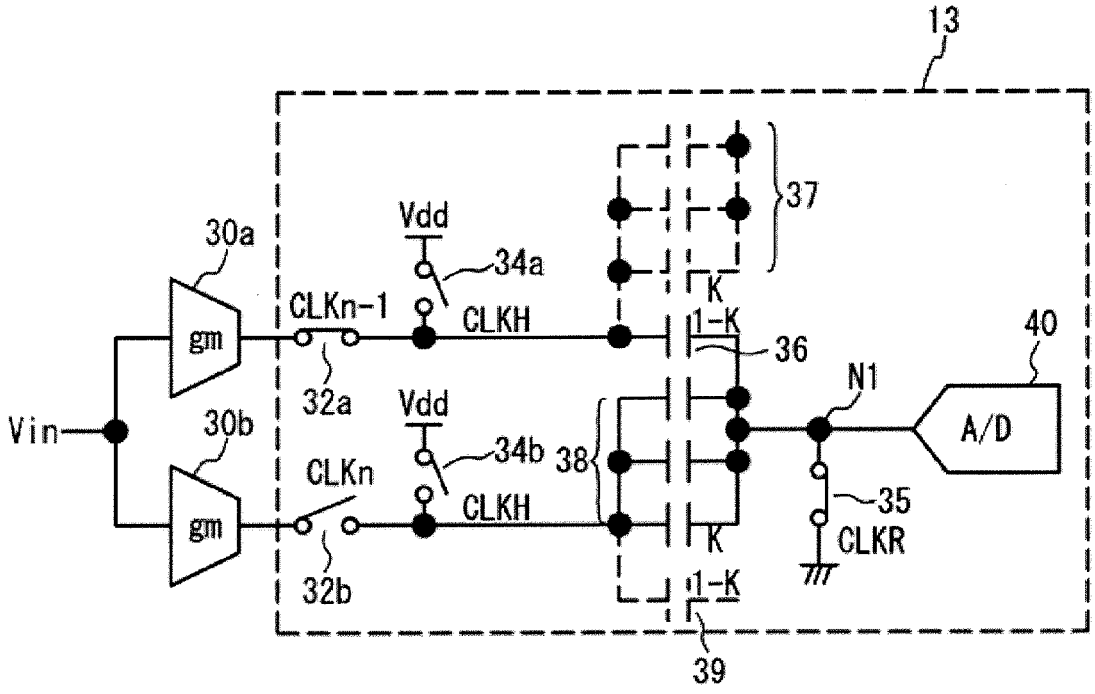
FIG. 3 illustrates an example of an interpolation circuit.

FIG. 3 illustrates an example of an interpolation circuit. An interpolation circuit illustrated in FIG. 3 generates interpolation data from two pieces of input data that are chronologically adjacent to each other. One portion of an interpolation circuit 12 includes gm circuits 30*a* and 30*b*, and a sampling circuit 13. The sampling circuit 13 includes switches 32*a*, 32*b*, 34*a*, 34*b*, and 35, variable capacitors 36 and 38, and an analog-to-digital (A/D) converter 40. The path between an input Vin and a node N1 is divided into two paths. Along one of the paths, the gm circuit 30*a*, the switch 32*a*, and the variable capacitor 36 are electrically coupled in series. The gm circuit 30*a* is a voltage-to-current converter circuit that converts an input signal Vin into a current. The switch 32*a* is electrically coupled between the output terminal of the gm circuit 30*a* and one of two terminals of the variable capacitor 36. The switch 34*a* is electrically coupled between the terminal of the variable capacitor 36 and a power supply Vdd. The other terminal of the variable capacitor 36 is connected to the node N1.

Along the other path, the gm circuit 30*b*, the switch 32*b*, and the variable capacitor 38 are electrically coupled in series. The gm circuit 30*b* is a voltage-to-current converter circuit that converts the input signal Vin into a current. The switch 32*b* is electrically coupled between the output terminal of the gm circuit 30*b* and one of two terminals of the variable capacitor 38. The switch 34*b* is electrically coupled between the terminal of the variable capacitor 38 and the power supply Vdd. The other terminal of the variable capacitor 38 is coupled to the node N1. The switch 35 is electrically coupled between the node N1 and the ground. The node N1 is coupled to the A/D 40. The switches 32*a*, 32*b*, 34*a*, 34*b*, and 35 are turned on when the levels of clocks CKn-1, CKn, CLKH, CLKH, and CLKR are at a high level, respectively, and turned off when the levels of the clocks CKn-1, CKn, CLKH, CLKH, and CLKR are at a low level, respectively. The variable capacitor 36 has a capacitance value corresponding to 1-k, and a capacitor 37 corresponding to k does not contribute to the capacitance value. The variable capacitor 38 has a capacitance value corresponding to k, and a capacitor 39 corresponding to 1-k does not contribute to the capacitance value.

Figure 4:
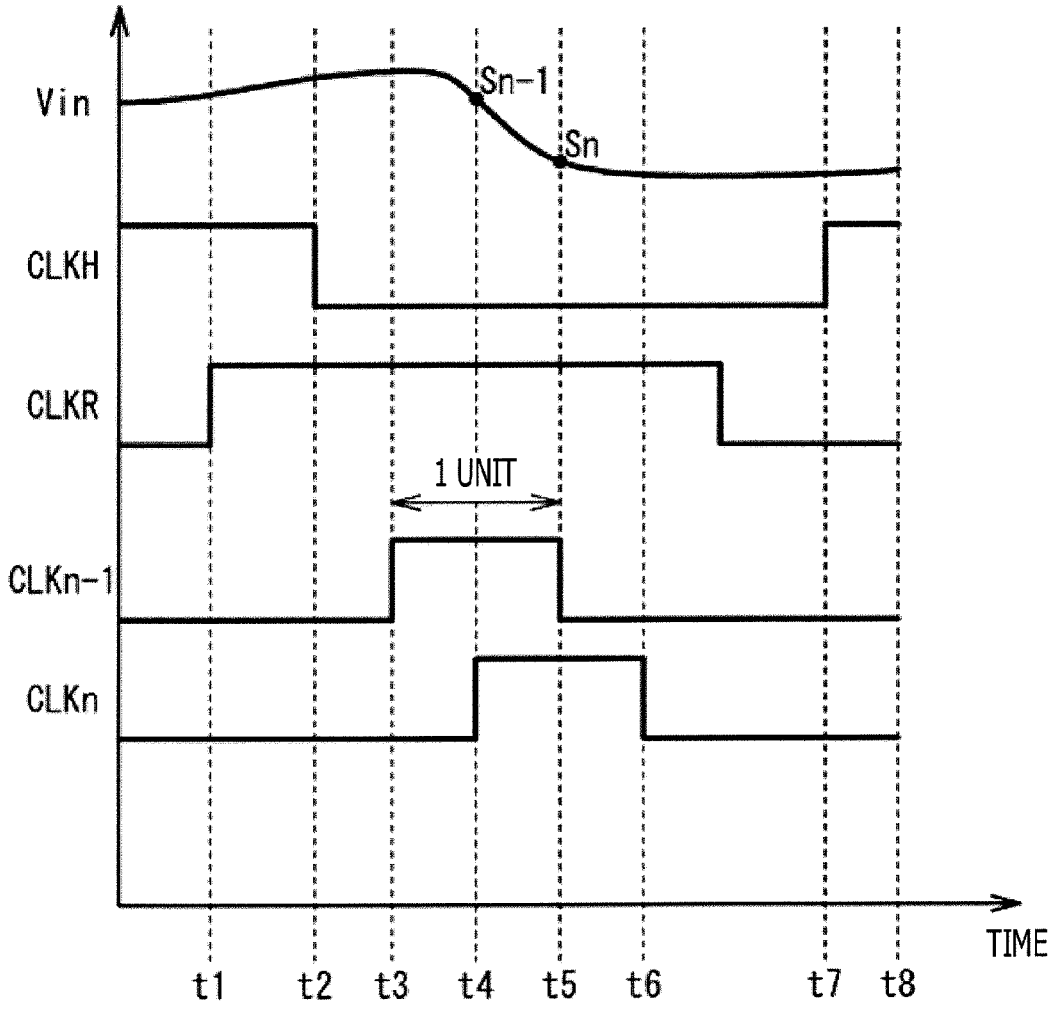
FIG. 4 illustrates examples of a operation of a switch.
Figure 5:
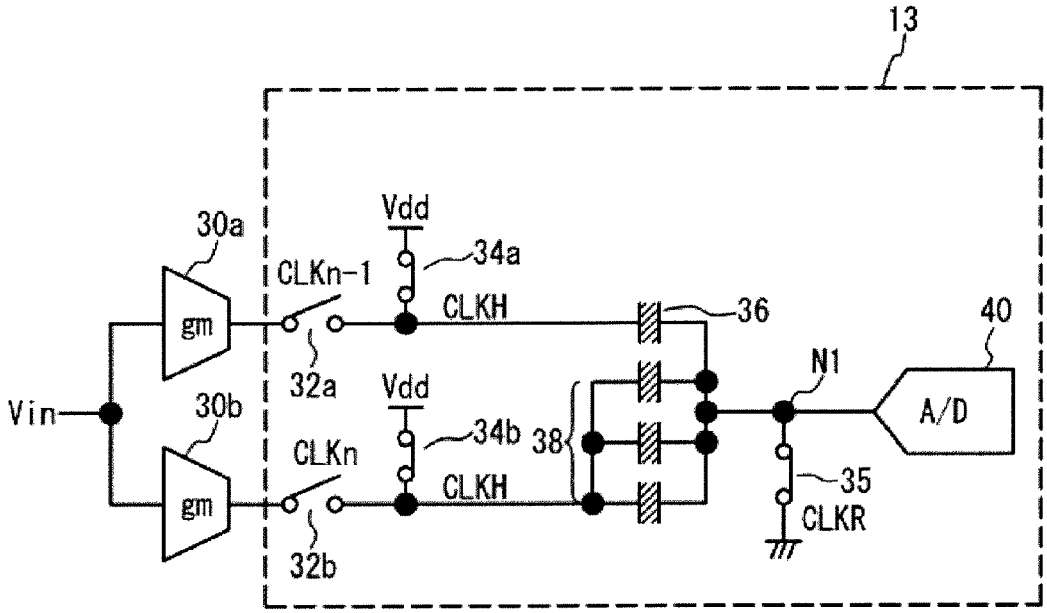
FIG. 5 illustrates an example of an interpolation circuit.

FIG. 4 illustrates examples of an operation of a switch. FIGS. 5, 6, 7, and 8 illustrate an example of a interpolation circuit. The hatched portions in the capacitors 36 and 38 that are illustrated in FIGS. 5 to 8 indicate the amounts of charge accumulated in the capacitors 36 and 38, respectively. The areas of the hatched portions correspond to the amounts of accumulated charge. In FIGS. 4 and 5, for a time period between a time ti and a time t2, the levels of the clocks CLKH, CLKR, CLKn-1, and CLKn are high, high, low, and low, respectively. In this time period, each of the variable capacitors 36 and 38 is electrically coupled in series between the power supply Vdd and the ground. Thus, the variable capacitors 36 and 38 are charged.

Figure 6:
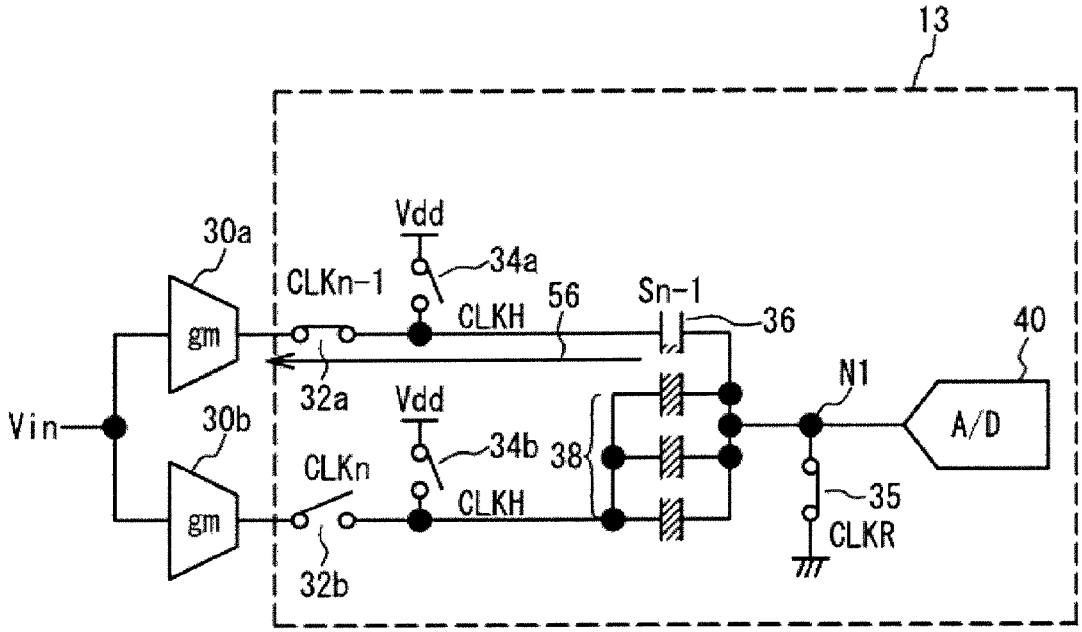
FIG. 6 illustrates an example of an interpolation circuit.

In FIGS. 4 and 6, for a time period between a time t3 and a time t5, the levels of the clocks CLKH, CLKR, and CLKn-1 are low, high, and high, respectively. In this time period, the variable capacitor 36 is electrically coupled in series between the gm circuit 30*a* and the ground. Thus, charge is extracted from the variable capacitor 36 as indicated by the arrow 56. In the variable capacitor 36, charge corresponding to the input signal Vin (which corresponds to the input data item Sn-1) for the time period between the time t3 and the time t5 is accumulated.

Figure 7:
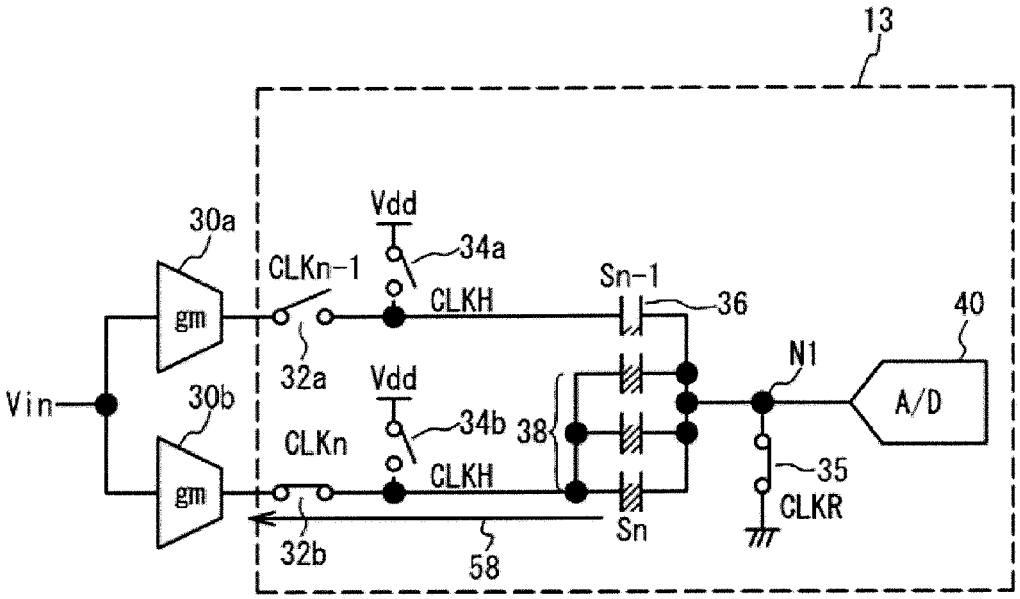
FIG. 7 illustrates an example of an interpolation circuit.

In FIGS. 4 and 7, for a time period between a time t4 and a time t6, the levels of the clocks CLKH, CLKR, and CLKn are low, high, and high, respectively. In this time period, the variable capacitor 38 is electrically coupled in series between the gm circuit 30*b* and the ground. Thus, charge is extracted from the variable capacitor 38 as indicated by the arrow 58. In the variable capacitor 38, charge corresponding to the input signal Vin (which corresponds to the input data item Sn) for the time period between the time t4 and the time t6 is accumulated.

Figure 8:
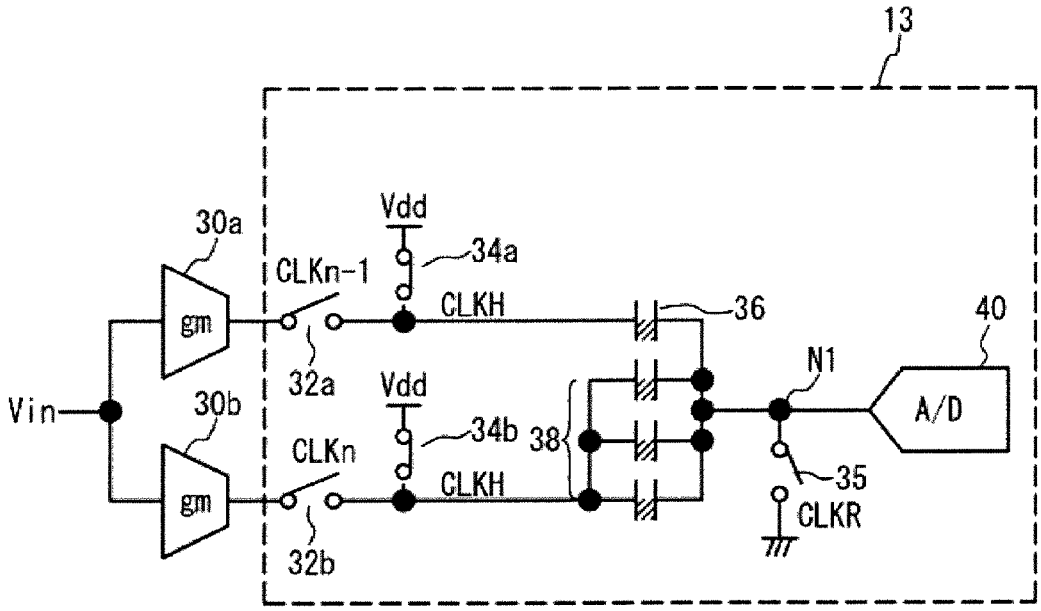
FIG. 8 illustrates an example of an interpolation circuit.

In FIGS. 4 and 8, for a time period between a time t7 and a time t8, the levels of the clocks CLKH, CLKR, CLKn-1, and CLKn are high, low, low, and low, respectively. In this time period, the variable capacitors 36 and 38 are electrically coupled in parallel between the power supply Vdd and the node N1. The node N1 is disconnected from the ground. Thus, charge accumulated in the variable capacitor 36 and charge accumulated in the variable capacitor 38 are combined together. The voltage at the node N1 is a value corresponding to the interpolation data Dn. The A/D 40 converts the voltage at the node N1 into a digital value, and outputs the digital value.

As described above, the interpolation data Dn is generated from the input data Sn-1 and Sn.

Figure 9:
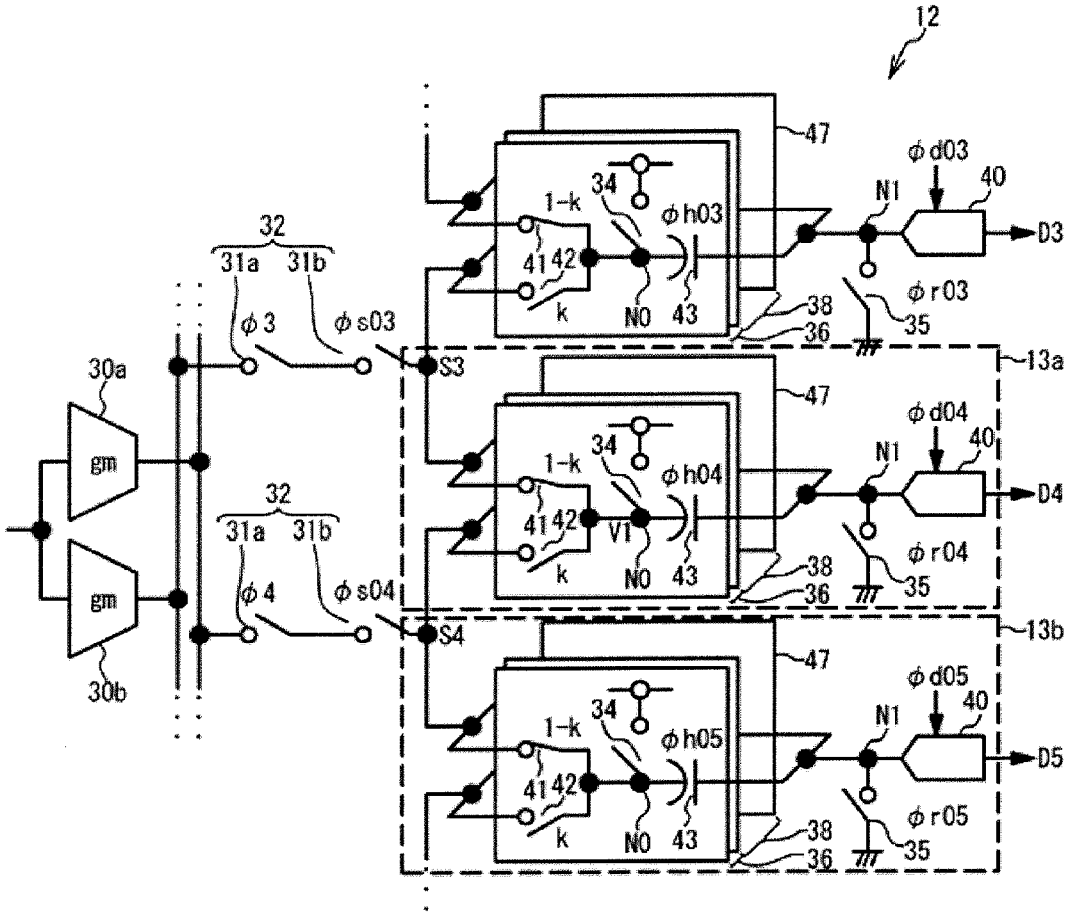
FIG. 9 illustrates an example of an interpolation circuit.

FIG. 9 illustrates an example of an interpolation circuit. An interpolation circuit 12 illustrated in FIG. 9 includes the gm circuits 30*a* and 30*b*, and a plurality of the sampling circuits 13*a* and a plurality of sampling circuits 13*b*. The sampling circuit 13*a* and a sampling circuits 13*b* that are adjacent to each other share a corresponding switch 32. In the switch 32, a switch 31*a* and a switch 31*b* are coupled in series. Each of the sampling circuits 13*a* and the sampling circuits 13*b* includes a plurality of slices 47 (Nc slices 47), for example, 32 slices 47. Each of the slices 47 includes switches 34, 41, and 42, and a capacitor 43. The switch 41 is coupled between the switch 32 that outputs the input data Sn-1 (an input data S3 in the sampling circuit 13*a*) and one of two terminals of the capacitor 43. The switch 42 is coupled between the switch 32 that outputs the input data Sn (an input data S4 in the sampling circuit 13*a*) and the terminal of the capacitor 43. The other terminal of the capacitor 43 is coupled to the output node N1. The variable capacitor 43 may be substantially the same as or similar to, for example, the switch 34 illustrated in FIG. 6, and is coupled between one (a node NO) of the two terminals of the variable capacitor 43 and a power supply Vcc. In order to make it possible to charge all of the capacitors 43, the switch 34 may be provided in each of the slices 47.

The Nc slices 47 are coupled in parallel. The capacitance values of the capacitors 43 of the Nc slices 47 may be substantially the same. Each of the switches 41 and a corresponding one of the switches 42 perform switching between on and off in a complementary manner. For example, when the switch 41 is turned on, the switch 42 is turned off, and, when the switch 41 is turned off, the switch 42 is turned on. Thus, the capacitor 43 of the slice 47 in which the switch 41 is turned on is coupled in parallel to the switch 32 corresponding to the input data item Sn-1, and the capacitor 43 of the slice 47 may correspond to the variable capacitor 36. The capacitor 43 of the slice 47 in which the switch 42 is turned on is coupled in parallel to the switch 32 corresponding to the input data item Sn, and the capacitor 43 of the slice 47 may correspond to the variable capacitor 38. Thus, the sum of the capacitance values of the variable capacitors 36 and the sum of the capacitance values of the variable capacitors 38 may be substantially the same. When the interpolation code k changes from 0 to 1, among the Nc slices 47, the switches 41 of (Nc×(1−k)) slices 47 are turned on, and (Nc×k) switches 42 are turned on. Thus, a voltage that is in proportion to an expression (1−k)×Sn-1+k×Sn is generated at the output node N1. The A/D 40 outputs the voltage at the node N1 as the interpolation data Dn.

Figure 10:
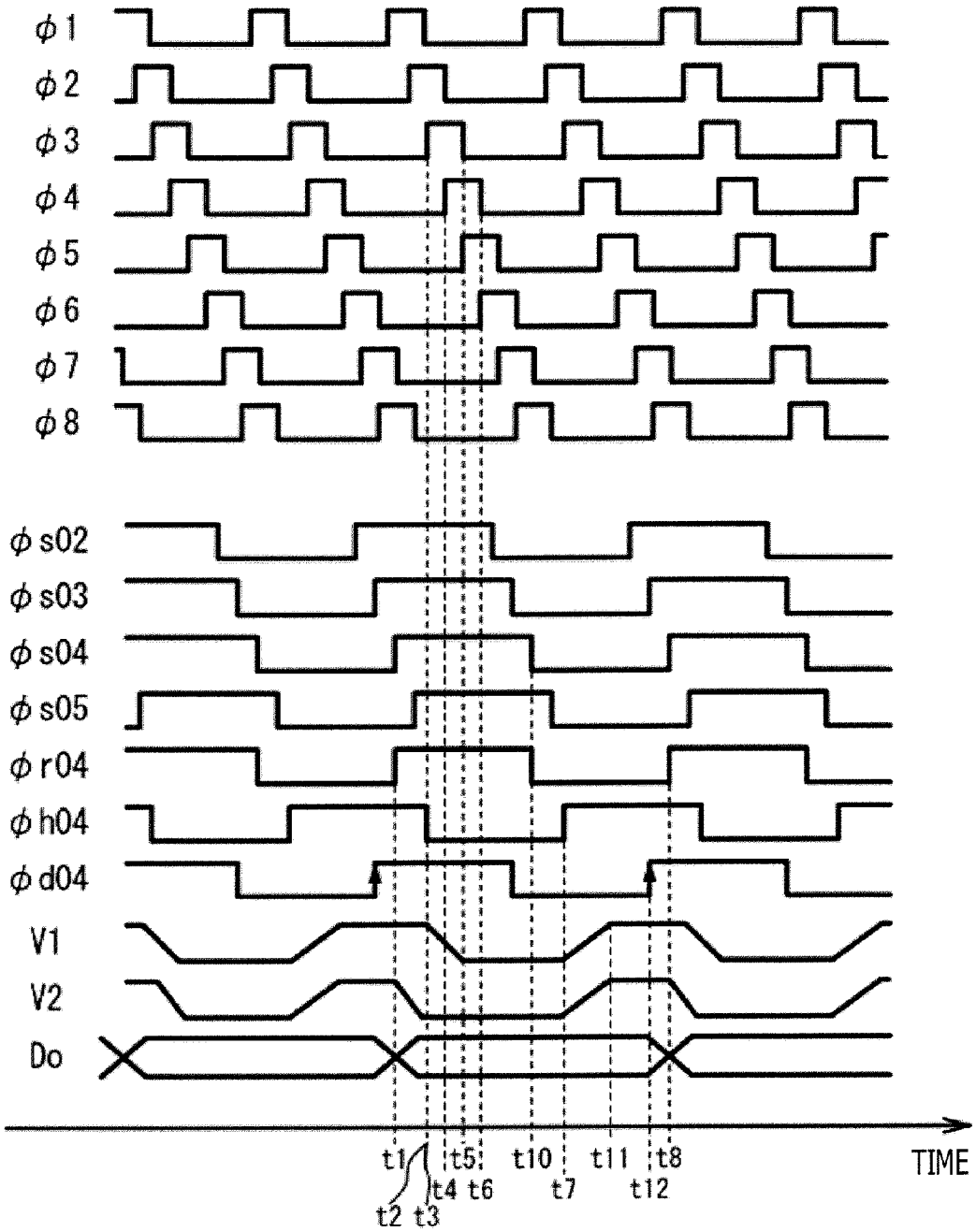
FIG. 10 illustrates an example of a timing chart of signals used to control switches.

FIG. 10 illustrates an example of a timing chart of signals used to control switches. Signals ϕn, for example, signals ϕ1 to ϕ8, may be signals that are used to control the switches 31*a*. Signals ϕs0*n*, for example, signals ϕs02 to ϕs05, may be signals that are used to control the switches 31*b*. Signals ϕr0*n* and ϕh0*n* may be signals that are used to control the switches 35 and 34, respectively. A signal ϕd0*n* may be a sampling signal that is used for the A/D 40. In FIG. 10, signals ϕr0*n*, ϕh0*n*, and ϕd0*n* are illustrated as the signals ϕr0*n*, ϕh0*n*, and ϕd0*n*. Signals ϕr0*n*, ϕh0*n*, and ϕd0*n* in the case where n is any number other than 4 may be signals that are delayed based on n as in the case of the signals ϕn and ϕs0*n*. For example, the signal ϕr04 may be a signal that is substantially the same as the signal ϕs04. The signal ϕh04 may be a signal that is substantially the same as the inverted signal of the signal ϕs06. The signal ϕd04 may be a signal that is substantially the same as the signal ϕs03.

Voltages V1 and V2 are the voltages at the nodes N0 and N1, respectively. The high level of the voltage V1 may be Vdd, and the low level of the voltage V2 may be the ground potential. Do denotes an output data.

For a time period from a time t1 to a time t2, as illustrated in FIG. 5, the variable capacitors 36 and 38 are charged. In this case, the level of the voltage V1 at the node N0 may be Vdd, and the level of the voltage V2 at the node N1 may be the ground potential. For a time period from a time t3 to a time t5, both of the levels of the signals for the switches 31*a* and 31*b* that correspond to the input data S3 become high. Thus, as illustrated in FIG. 6, charge accumulated in the variable capacitor 36 is discharged. At the time t5, the voltage V1 is a voltage corresponding to the input data item S3. For the time period from a time t4 to a time t6, both of the levels of the signals for the switches 31*a* and 31*b* that correspond to the input data item S4 becomes high. Thus, as illustrated in FIG. 7, charge accumulated in the variable capacitor 38 is discharged. For a time period from a time t7 to a time t8, as illustrated in FIG. 8, the switch 35 is turned off, and the switch 34 is turned on. Thus, the voltage V2 at the node N1 increases, and, at a time t11 and times thereafter, the voltage V2 becomes a voltage corresponding to an interpolation data D4. At a time t12, the level of the signal ϕd04 becomes high, and the A/D 40 samples the voltage V2. The interpolation data D4 may be a boundary data of the output data Do. Other interpolation data Dn may be similarly generated.

Because, as illustrated in FIG. 9, the switches 41 and 42 are coupled in series on a line on which a signal is transmitted, signal loss may occur. Because the switches 41 and 42 are provided in each of the slices 47, the number of switches may increase. For example, as illustrated in FIG. 10, a time at which both of the switches 31*a* are turned on by the levels of the signals ϕ3 and ϕ4 may occur between the time t2 at which the level of the signal ϕh04 becomes low and a time t10 at which the level of the signal ϕr04 becomes low.

Figure 11:
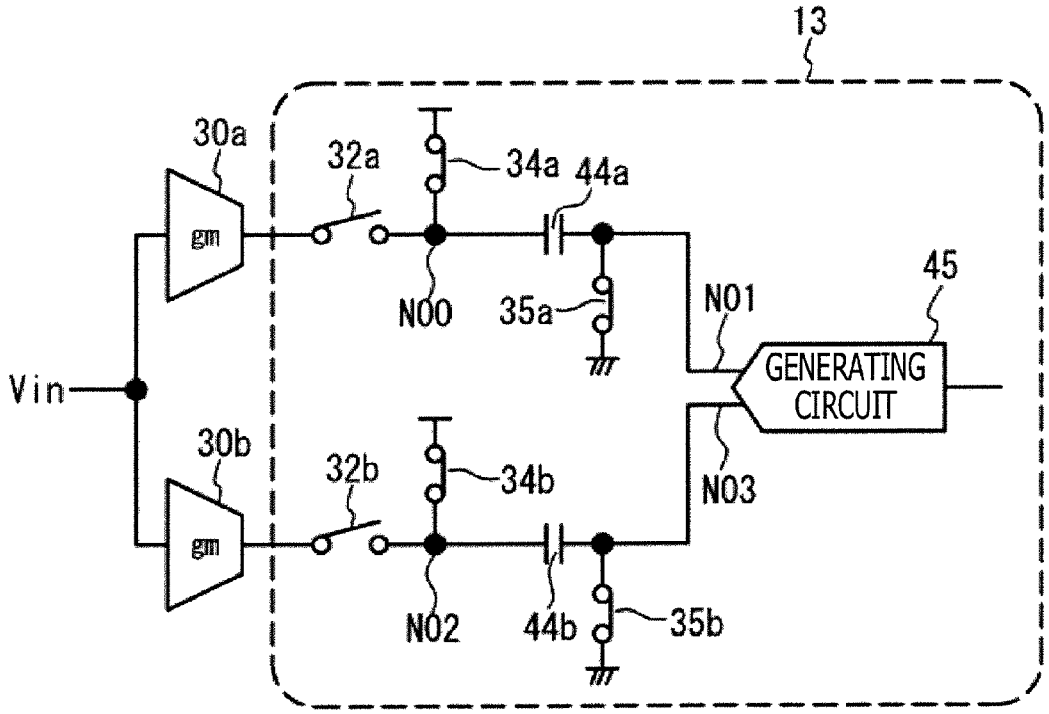
FIG. 11 illustrates an example of an interpolation circuit.

FIG. 11 illustrates an example of an interpolation circuit. In FIG. 11, one portion of the interpolation circuit is illustrated. An interpolation circuit illustrated in FIG. 11 generates interpolation data from two pieces of input data that are chronologically adjacent to each other. One portion of an interpolation circuit 12 illustrated in FIG. 11 includes gm circuits 30*a* and 30*b*, and a sampling circuit 13. The sampling circuit 13 includes switches 32*a*, 32*b*, 34*a*, 34*b*, 35*a*, and 35*b*, capacitors 44*a* and 44*b*, and a generating circuit 45. The capacitors 44*a* and 44*b* may be capacitors having a fixed capacitance value. The gm circuit 30*a*, the switch 32*a*, and the capacitor 44*a* are electrically coupled in series between an input Vin and a node N01. The gm circuit 30*a* may be a voltage-to-current converter circuit that converts an input signal Vin into a current. The switch 32*a* is electrically coupled between the output terminal of the gm circuit 30*a* and one (a node N00) of two terminals of the capacitor 44*a*. The other terminal of the capacitor 44*a* is coupled to the node N01. The switch 34*a* is electrically coupled between the node N00 and a power supply Vdd. The switch 35*a* is electrically coupled between the node N01 and the ground.

The gm circuit 30*b*, the switch 32*b*, and the capacitor 44*b* are electrically coupled in series between the input Vin and a node N03. The gm circuit 30*b* is a voltage-to-current converter circuit that converts the input signal Vin into a current. The switch 32*b* is electrically coupled between the output terminal of the gm circuit 30*b* and one (a node N02) of two terminals of the capacitor 44*b*. The switch 34*b* is electrically coupled between the node N02 and the power supply Vdd. The other terminal of the capacitor 44*b* is coupled to the node N03. The switch 35*b* is electrically coupled between the node N03 and the ground. A voltage at the node N01 and a voltage at the node N03 are input to the generating circuit 45. The generating circuit 45 assigns weights, based on an interpolation code, to the voltage at the node N01 and the voltage at the node N03 to obtain weighted voltages, and combines the weighted voltages together, thereby generating an interpolation data.

Figure 12:
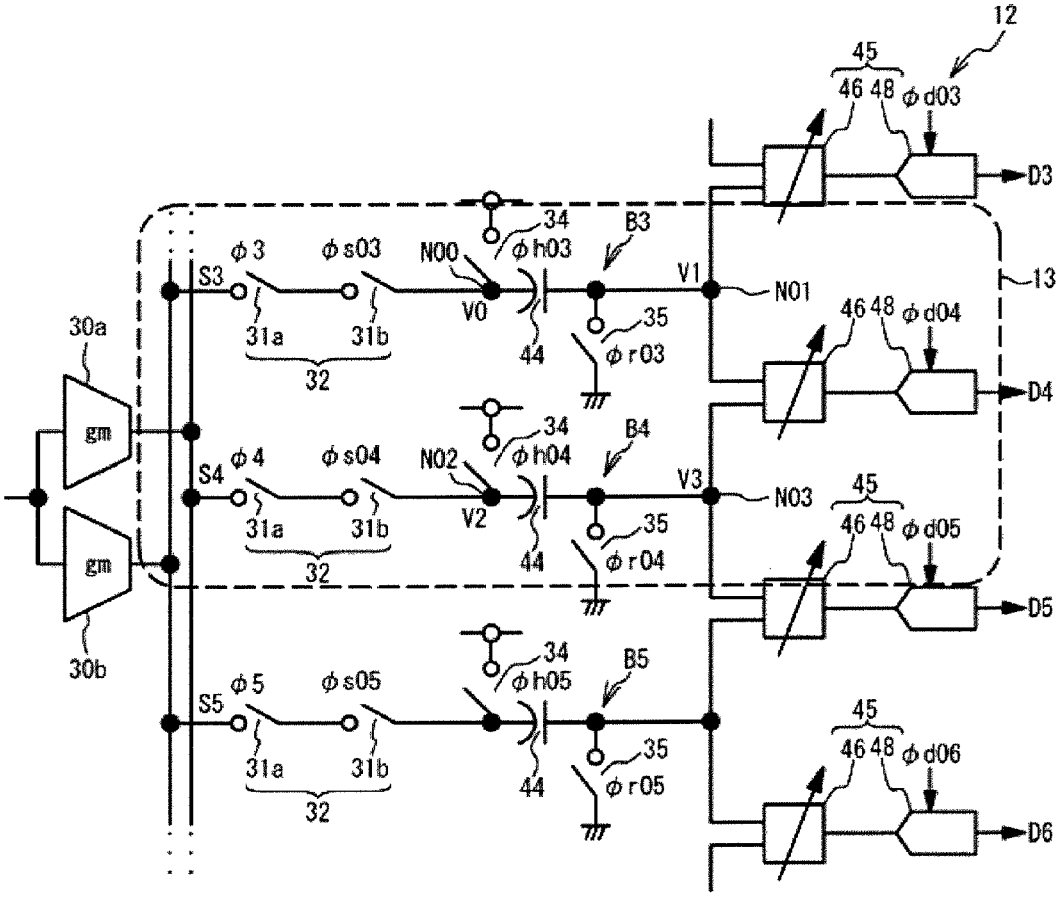
FIG. 12 illustrates an example of an interpolation circuit.

FIG. 12 illustrates an example of an interpolation circuit. An interpolation circuit 12 illustrated in FIG. 12 includes the gm circuits 30*a* and 30*b*, and a plurality of holding circuits Bn (n is a natural number). In FIG. 12, the holding circuits B3 to B5 are illustrated. Each of the holding circuits Bn includes switches 32, 34, and 35, and a capacitor 44, and holds the input data Sn that has been chronologically input. A sampling circuit that outputs the interpolation data Dn includes the holding circuits Bn-1 and Bn. For example, the sampling circuit 13 that outputs an interpolation data D4 and the sampling circuit that outputs an interpolation data D5 share the holding circuit B4. As illustrated in FIG. 9, in the switch 32 of each of the holding circuits Bn, switches 31*a* and 31*b* are coupled in series. The generating circuit 45 includes a weighting circuit 46 and a determination circuit 48.

In the capacitor 44, charge corresponding to the input data Sn is accumulated when the switch 32 is turned on. Thus, the voltage at the node N01 and the voltage at the node N03 are voltages V1 and V3 corresponding to the input data S3 and S4, respectively. The weighting circuit 46 combines a voltage V1 at the node N01 and a voltage V2 at the node N03 together based on an interpolation code. The determination circuit 48 compares the output of the weighting circuit 46 with a reference value, thereby performing conversion into a digital signal, for example, a high-level signal or a low-level signal. For example, the capacitance values of the capacitors 44 may be substantially the same.

Figure 13:
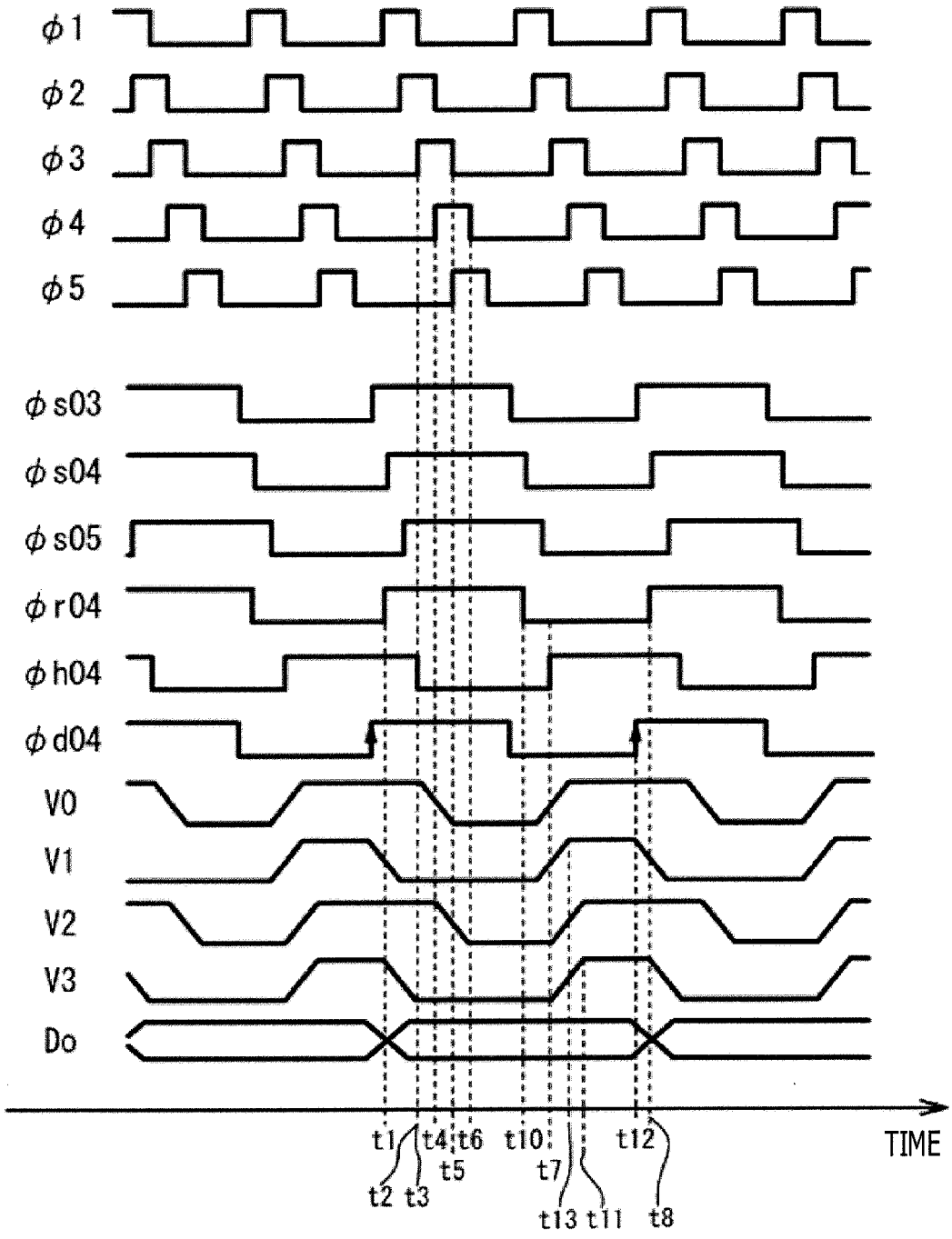
FIG. 13 illustrates an example of a timing chart of signals used to control switches.

FIG. 13 illustrates an example of a timing chart of signals used to control switches. Signals ϕn, for example, signals ϕ1 to ϕ5, may be signals that are used to control the switches 31*a* of the holding circuits Bn. Signals ϕs0*n*, for example, signals ϕs03 to ϕs05, may be signals that are used to control the switches 31*b* of the holding circuits Bn. Signals ϕr0*n* and ϕh0*n* may be signals that are used to control the switches 35 and 34, respectively, of each of the holding circuits Bn. A signal ϕd0*n* may be a sampling signal that is input to the determination circuit 48 which outputs the interpolation data Dn. In FIG. 13, signals ϕr04, ϕh04, and ϕd04 are illustrated as the signals ϕr0*n*, ϕh0*n*, and ϕd0*n*. Signals ϕr0*n*, ϕh0*n*, and ϕd0*n* in the case where n is any number other than 4 may be signals that are delayed by a certain time period based on n as in the case of the signals ϕn and ϕs0*n*. For example, the signal ϕr04 may be a signal that is substantially the same as the signal ϕs04. The signal ϕh04 may be a signal that is substantially the same as the inverted signal of the signal ϕs06. The signal ϕd04 may be a signal that is substantially the same as the signal ϕs03.

Voltages V0 to V3 are the voltages at the nodes N00 to N03, respectively. The high level of each of the voltages V0 and V2 may be Vdd, and the low level of each of the voltages V1 and V3 may be the ground potential. Do denotes an output data item.

For a time period from a time t1 to a time t2, the level of each of the signals ϕr04 and ϕh04 is at a high level, and the switches 34 and 35 of the holding circuit B4 are turned on. Thus, the capacitor 44 of the holding circuit B4 is charged. In this case, the level of the voltage V2 at the node N02 may be Vdd, and the level of the voltage V3 at the node N03 may be the ground potential. For a time period for which the levels of the signals ϕr03 and ϕh03 are at a high level, the level of the voltage V0 at the node N00 of the holding circuit B3 is Vdd, and the level of the voltage V1 at the node N01 is the ground potential. For a time period between a time t3 and a time t5, the levels of the signals ϕ3 and ϕs03 are high, and the both of the switches 31*a* and 31*b* of the holding circuit B3 are turned on. Thus, charge accumulated in the capacitor 44 of the holding circuit B3 is discharged. At the time t5, the voltage V0 is a voltage corresponding to the input data item S3. For a time period between a time t4 and a time t6, both of the levels of the signals for the switches 31*a* and 31*b* of the holding circuit B4 are high. Thus, charge accumulated in the capacitor 44 of the holding circuit B4 is discharged. At the time t6, the voltage V2 becomes a voltage corresponding to the input data S4.

For a time period between a time t7 and a time t8, the switch 35 of the holding circuit B4 is turned off, and the switch 34 is turned on. Thus, the voltage V1 at the node N03 increases, and, at a time t11 and times thereafter, the voltage V3 is a voltage corresponding to the input data S4. For example, in the holding circuit B3, at a time t13 and times thereafter, the voltage V1 is a voltage corresponding to the input data S3. The weighting circuit 46 assigns weights to the voltages V1 and V3 to obtain weighted voltages, and combines the weighted voltages together to obtain a combined voltage. When the level of the signal ϕd04 becomes high at the time t12, the determination circuit 48 generates the interpolation data D4 from the combined voltage.

As illustrated in FIG. 13, each of the signals ϕn, ϕs0*n*, ϕr0*n*, ϕh0*n*, and ϕd0*n* is a signal that is delayed by a certain time period every time n is increased by 1. Thus, the individual holding circuits Bn and the generating circuits 45 perform, for example, a time interleave operation, thereby generating, from the input data Sn, interpolation data Dn that are continuous with respect to n.

For example, in FIG. 9, the switch 32 corresponding to the input data S3 and the switch 32 corresponding to the input data S4 are coupled to the switches 34 and 35 corresponding to the interpolation data D4. Thus, as illustrated in FIG. 10, a pulse of the signal ϕ3 and a pulse of the signal ϕ4 are provided between the time t2 at which the level of the signal ϕh04 becomes low and the time t10 at which the level of the signal ϕr04 becomes low. For example, in a time period between the time t2 and the time t10, the level of the signal ϕ3 changes low, high, and low, and, after the level of the signal ϕ3 changes, the level of the signal ϕ4 changes low, high, and low.

For example, in FIG. 12, only the switch 32 corresponding to the input data S4 among the switches 32 is coupled to the switches 34 and 35 of the holding circuit B4. Thus, as illustrated in FIG. 13, a pulse of the signal ϕ4 is provided between the time t2 at which the level of the signal ϕh04 becomes low and the time t10 at which the level of the signal ϕr04 becomes low. For example, in a time period between the time t2 and the time t10, the level of the signal ϕ4 changes low, high, and low. As the operating speed of the circuit increases, it may become difficult to make the pulse width of the signal ϕn smaller than the pulse width of each of the signals ϕh0*n* and ϕr0*n*. For example, in the interpolation circuit illustrated in FIGS. 11 and 12, the margin of the pulse width may increase, and the interpolation circuit may deal with an increase in the operation speed thereof.

For example, as illustrated in FIGS. 12 and 13, the plurality of holding circuits Bn individually hold a plurality of input data that have been chronologically input. The weighting circuit 46 of each of the generating circuits 45 assigns weights, based on an interpolation code, to input data which are held by holding circuits Bn which are adjacent to each other among the plurality of holding circuits Bn to obtain weighted data and combines the weighted data together to obtain combined data. The determination circuit 48 of the generating circuit 45 generates interpolation data from the combined data item. For example, the determination circuit 48 compares the output of the weighting circuit 46 with a reference value, and determines whether or not the level of the output is a high level or a low level, thereby generating digital data as interpolation data. The holding circuits Bn hold input data that is input at different times, and each of the generating circuits 45 generates interpolation data based on the input data that are held and an interpolation code. Thus, the switches 41 and 42 illustrated in FIG. 9 may not be provided. Thus, an increase in the impedance that is caused by the switches 41 and 42 may be reduced, and signal loss may be reduced. Because the switches 41 and 42 and the capacitor 43 are not provided in each of the slices 47, the circuit area may be reduced. As illustrated in FIG. 13, because at least one signal ϕn is inserted between the time t2 and the time t10, the margin of the pulse width may increase. Thus, the operation speed of the circuit may increase.

Each of the plurality of holding circuits Bn may include the capacitor 44 in which charge corresponding to the voltage of the input data Sn is to be accumulated. The plurality of holding circuits Bn may hold input data. In the case where the capacitors 44 are used, the capacitance values of the plurality of capacitors 44 may be substantially the same, and interpolation data items may be easily generated.

As illustrated in FIG. 12, in the holding circuits Bn, each of the plurality of switches 34 is coupled in series between one of two terminals of a corresponding one of the plurality of capacitors 44 and the power supply Vdd. Each of the plurality of switches 35 is coupled in series between the other terminal of a corresponding one of the plurality of capacitors 44 and the ground. Each of the plurality of switches 32 applies a current corresponding to the corresponding input data Sn, to the terminal of the corresponding capacitor 44. Thus, in the capacitor 44, charge corresponding to the input data Sn is accumulated.

As illustrated in FIG. 13, for each of the capacitors 44, a time period for which a corresponding one of the switches 32 is turned on (the level of the signal ϕn is high) is included for a time period for which a corresponding one of the switches 34 is turned off (the level of the signal ϕh0*n* is low) and for which a corresponding one of the switches 35 is turned on (the level of the signal ϕr0*n* is high). In this manner, at least one signal ϕn may be inserted between the time t2 and the time t10.

Generating circuits given below will be described using differential signals as individual signals. The individual signals may be differential signals in FIGS. 11 and 12.

Figure 14:
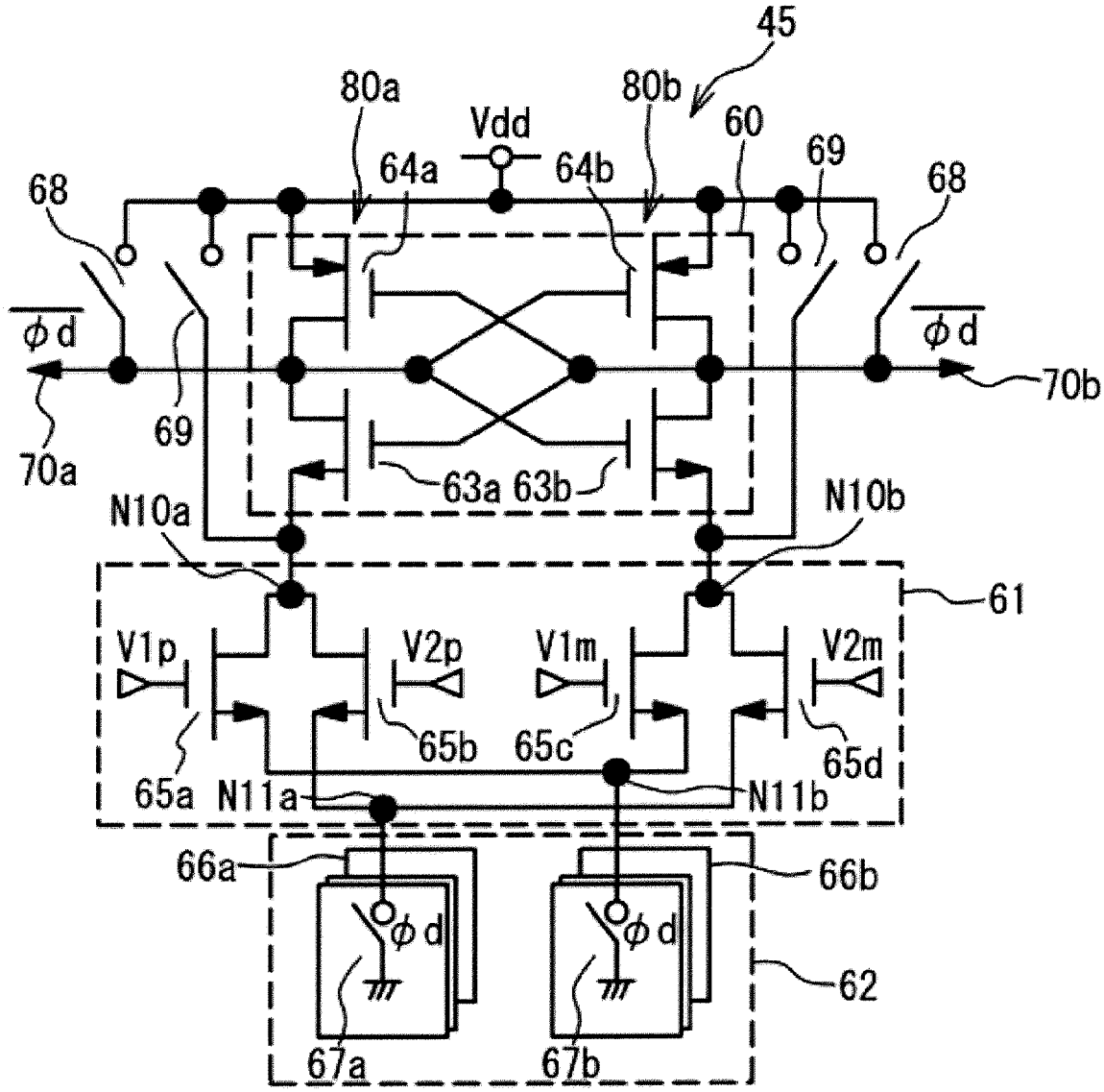
FIG. 14 illustrates an example of a generating circuit.

FIG. 14 illustrates an example of a generating circuit. A generating circuit illustrated in FIG. 14 may be the generating circuit illustrated in FIG. 11 or 12. Although differential signals are used in a generating circuit illustrated in FIG. 14, differential signals may be used in the interpolation circuits illustrated in FIGS. 11 and 12. A generating circuit 45 illustrated in FIG. 14 includes a latch circuit 60, a transistor 61, and a current source 62. The latch circuit 60 includes two inverters 80*a* and 80*b*. The individual inverters 80*a* and 80*b* include n-type field effect transistors (FETs) 63*a* and 63*b*, and p-type FETs 64*a* and 64*b*, respectively. The drains of the FETs 63*a* and 64*a* may be coupled at a common node, and the common node may correspond to the output node of the inverter 80*a*. The gates of the FETs 63*a* and 64*a* may be coupled at a common node, and the common node may correspond to the input node of the inverter 80*a*. The sources of the FETs 63*a* and 64*a* are coupled to a node N10*a* and a power supply Vdd (a second power supply), respectively. The inverter 80*b* also has connections similar to those of the inverter 80*a*.

The output node of the inverter 80*a* is coupled to the input node of the inverter 80*b*. The output node of the inverter 80*b* is coupled to the input node of the inverter 80*a*. The output nodes of the individual inverters 80*a* and 80*b* are coupled to output terminals 70*a* and 70*b*, respectively, of the generating circuit 45. Complementary signals are output from the output terminals 70*a* and 70*b* that are one pair of output terminals. When the level of the inverted signal of the signal ϕd, for example, the level of the inverted signal of the signal ϕd04 illustrated in FIG. 12 or 13, becomes high (the level of the signal ϕd becomes low), switches 68 are turned on. Data held by the latch circuit 60 is output from the output terminals 70*a* and 70*b*. The generating circuit 45 is activated by turning off switches 69.

The transistor 61 includes four n-type FETs 65*a* to 65*d*. The drains of the FETs 65*a* and 65*b* are coupled to the node N10*a* that is a common node. The drains of the FETs 65*c* and 65*d* are coupled to a node N10*b* that is a common node. The sources of the FETs 65*a* and 65*c* are coupled to a node N11*b* that is a common node. The sources of the FETs 65*b* and 65*d* are coupled to a node N11*a* that is a common node. Voltages V1*p*, V2*p*, V1*m*, and V2*m* are supplied to the gates of the FETs 65*a*, 65*b*, 65*c*, and 65*d*, respectively. The voltages V1*p* and V2*p* may be, for example, the voltages V1 and V3, respectively, illustrated in FIGS. 12 and 13. The voltages V1*m* and V2*m* are the inverted voltages of the voltages V1*p* and V2*p*, respectively.

The current source 62 includes a plurality of slices 66*a* and a plurality of slices 66*b*. For each of the slices 66*a*, a switch 67*a* that couples the node N11*a* and the ground (a first power supply) is provided. For example, a plurality of switches 67*a* are coupled between the node N11*a* and the ground. For each of the slices 66*b*, a switch 67*b* that couples the node N11*b* and the ground is provided. For example, the plurality of switches 67*b* are coupled between the node N11*b* and the ground. The switches 67*a* and 67*b* are turned on synchronously with the signal ϕd. The signal ϕd may correspond to, for example, the signal ϕd0*n* illustrated in FIGS. 12 and 13. Switches that are to be turned on may be selected among the switches 67*a* and 67*b* based on the interpolation code k.

For example, in the case where Nc slices 66*a* and Nc slices 66*b* are provided, the switches 67*a* of (k×Nc) slices (k is in the range from 0 to 1) among the slices 66*a* may be in synchronization with the signal ϕd. The switches 67*a* of the other slices are turned off regardless of the signal ϕd. The switches 67*b* of ((1−k)×Nc) slices among the slices 66*b* may be in synchronization with the signal ϕd. The switches 67*b* of the other slices are turned off regardless of the signal ϕd.

In the case where the current-voltage characteristics of the FETs 65*a* to 65*d* are linear, the current flowing at the node N10*a* may be represented by an expression A0×((1−k)×Sn-1+k×Sn)+I0. The current flowing at the node N10*b* may be represented by an expression −A0×((1−k)×Sn-1+k×Sn)+I0. For example, A0 may be a certain coefficient. I0 may be a current that flows at the node N10*a* (or the node N10*b*) when the voltages V1*p* and V2*p* (or the voltages V1*m* and V2*m*) are 0. The latch circuit 60 compares the potential at the node N10*a* and the potential at the node N10*b*, whereby whether the level of a voltage represented by the expression (1−k)×Sn-1+k×Sn is high or low is determined. In this manner, interpolation data represented by the equation Dn=(1−k)×Sn-1+k×Sn is generated. Processes that are substantially the same as or similar to processes which are performed in the circuits illustrated in FIGS. 1 to 3 or FIGS. 5 to 9 may be performed also in the circuits illustrated in FIGS. 11, 12, and 14.

Figure 15:
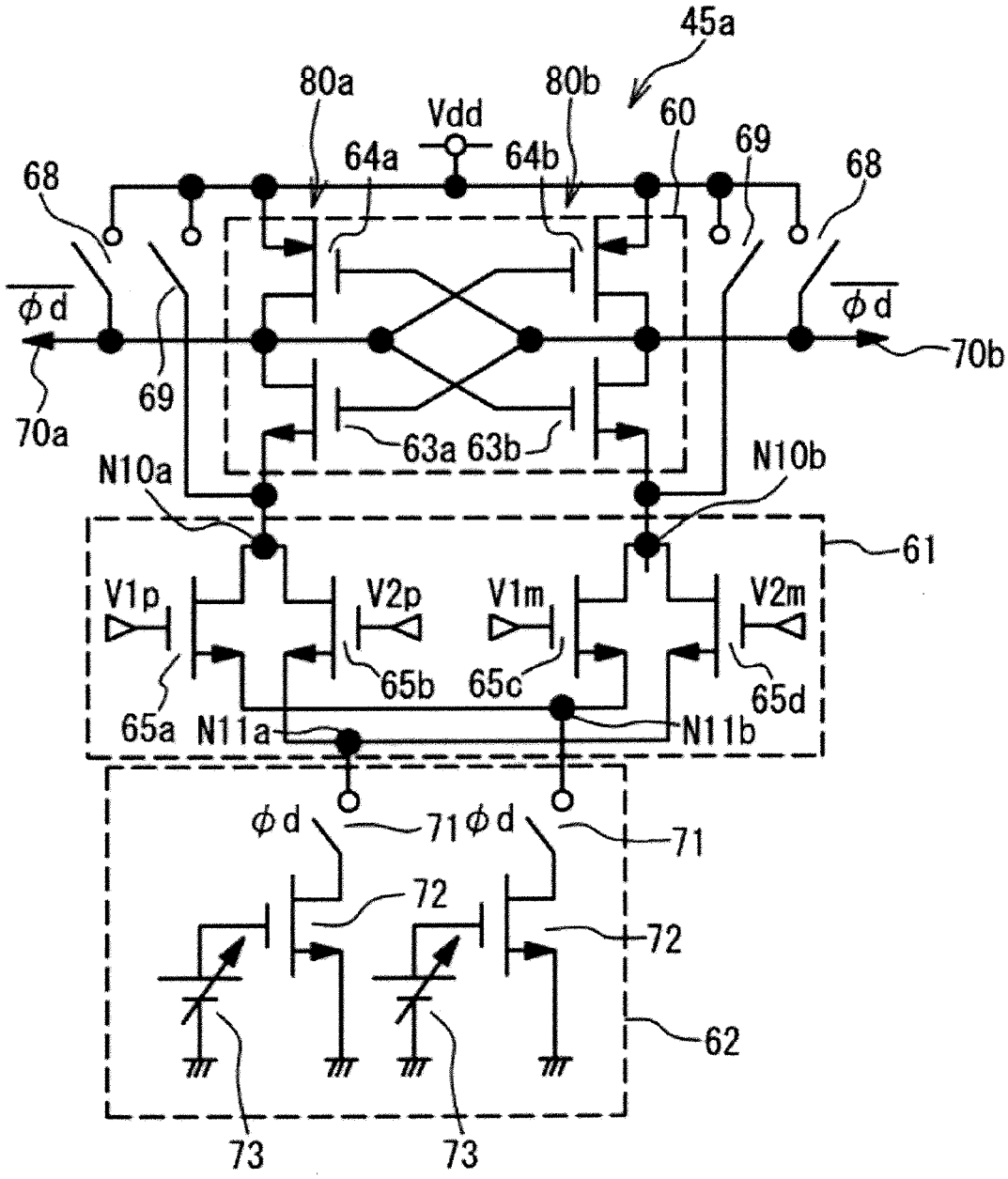
FIG. 15 illustrates an example of a generating circuit.

FIG. 15 illustrates an example of an generating circuit. A generating circuit illustrated in FIG. 15 may be the generating circuit illustrated in FIG. 11 or 12. A current source 62 of a generating circuit 45*a* illustrated in FIG. 15 includes switches 71, FETs 72, and variable power supplies 73. The drain of each of the FETs 72 is coupled via a corresponding one of the switches 71 to the node N11*a* or N11*b*. The switches 71 are turned on or off synchronously with the signal 4*d*. The sources of the FETs 72 are coupled to the ground. The gate of each of the FETs 72 is coupled to a corresponding one of the variable power supplies 73. The voltages of the variable power supplies 73 are controlled based on the interpolation code k. Thus, the current at the node N11*a* and the current at the node N11*b* change. In FIG. 15, the other configuration may be substantially the same as or similar to that illustrated in FIG. 14, and a description thereof may be omitted or reduced.

Figure 16:
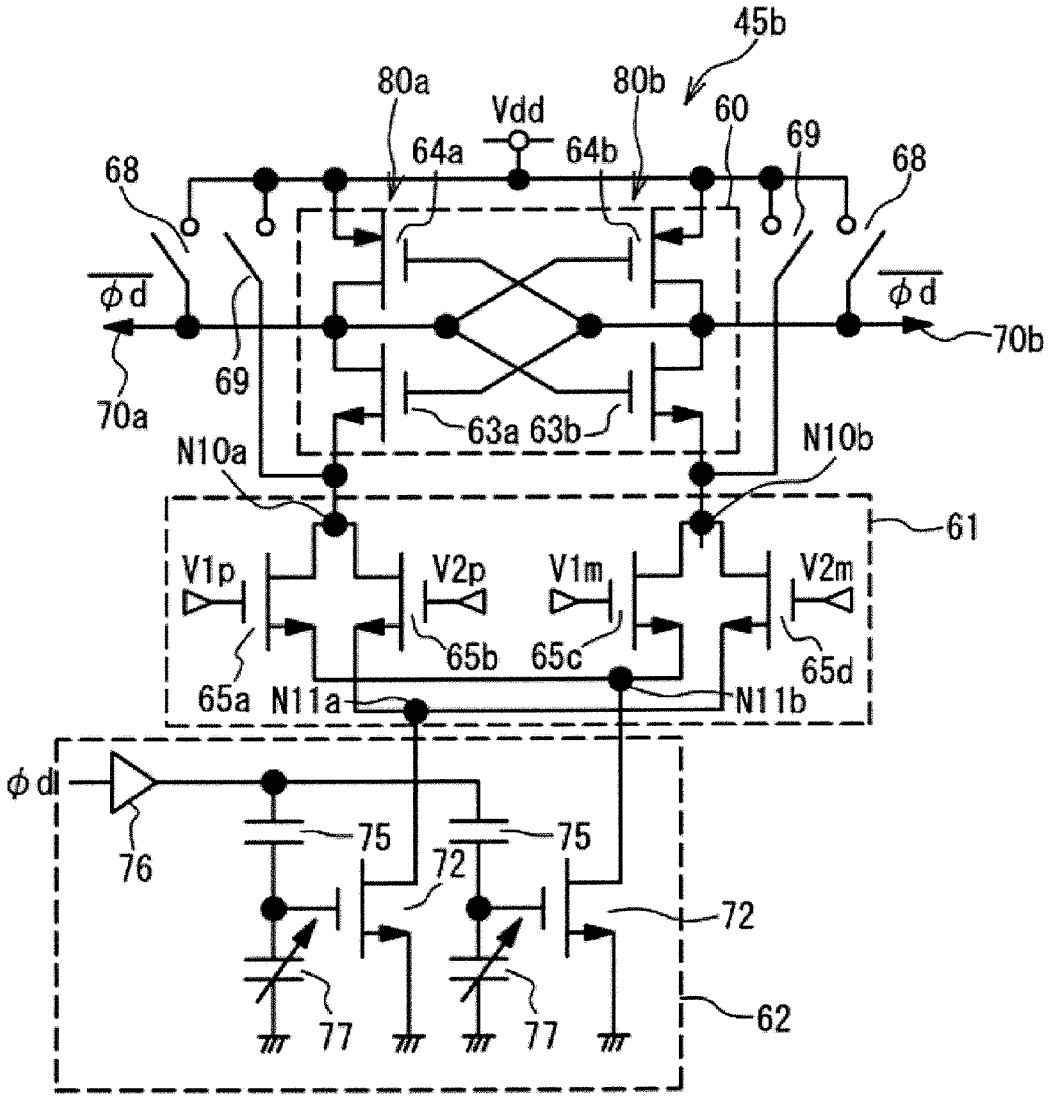
FIG. 16 illustrates an example of a generating circuit.

FIG. 16 illustrates an example of a generating circuit. A generating circuit illustrated in FIG. 16 may be the generating circuit illustrated in FIG. 11 or 12. A current source 62 of a generating circuit 45*b* illustrated in FIG. 16 includes FETs 72, variable capacitors 77, capacitors 75, and an amplifier 76. The drains of the FETs 72 are coupled to the node N11*a* or N11*b*. The sources of the FETs 72 are coupled to the ground. Each of the capacitors 77 is coupled between the gate of a corresponding one of the FETs 72 and the ground. Each of the capacitors 75 is coupled between the gate of a corresponding one of the FETs 72 and the output of the amplifier 76. The amplifier 76 amplifies the signal ϕd, and outputs the amplified signal ϕd. The output voltage of the amplifier 76 is divided using a ratio of the capacitance value of the capacitor 75 to the capacitance value of the variable capacitor 77, and the divided voltage is applied to the gate of a corresponding one of the FETs 72. The capacitance values of the variable capacitors 77 are controlled based on the interpolation code k. Thus, the current at the node N11*a* and the current at the node N11*b* change based on the interpolation code. The other configuration may be substantially the same as or similar to that illustrated in FIG. 14, and a description thereof may be omitted or reduced.

As illustrated in FIGS. 14 to 16, the input data Sn-1 and Sn is held by the holding circuits Bn-1 and Bn that are adjacent to each other. Each of the weighting circuits 46, for example, the current source 62 and the transistor 61, assigns weights to the input data Sn-1 and Sn based on the interpolation code to obtain weighted data items, and combines the weighted data together to obtain a combined data, and generates, at the nodes N10*a* and N10*b*, currents corresponding to the combined data. The determination circuit 48, for example, the latch circuit 60, determines, based on the currents flowing at the nodes N10*a* and N10*b*, whether the level of a voltage corresponding to interpolation data is high or low.

For example, the plurality of FETs 65*a* to 65*d* included in the transistor 61 control, using control terminals, for example, the voltages of the gates thereof, the currents flowing between the first terminals, for example, the sources thereof, and the second terminals, for example, the drains thereof. The output of one of two holding circuits that are adjacent to each other is input to the gate of the FET 65*a* or 65*c*. The output of the other holding circuit of the two holding circuits that are adjacent to each other is input to the gate of the FET 65*b* or 65*d*. The current source 62 changes, based on an interpolation code, a ratio of a current flowing between the sources and drains of the FETs 65*a* and 65*c* to a current flowing between the sources and drains of the FETs 65*b* and 65*d*. Thus, a potential represented by the expression (1−k)×Sn-1+k×Sn may be generated at the nodes N10*a* and N10*b*.

Interpolation signals are input to the gates of the FETs 65*b* and 65*d* and the gates of the FETs 65*a* and 65*c*. Thus, the potential at the node N10*a* and the potential at the node N10*b* are compared with each other, whereby whether the level of a voltage corresponding to interpolation data is high or low is determined.

The weighting circuit 46 assigns weights, based on the interpolation code, to the voltages V1*p* and V2*p* that are held by the holding circuits Bn-1 and Bn which are adjacent to each other to obtain weighted voltages, and combines the weighted voltages together to obtain combined data. The weighting circuit 46 generates, at the node N10*a*, a current corresponding to the combined data. The weighting circuit 46 assigns weights, based on the interpolation code, to the inverted voltages V1*m* and V2*m* of the voltages V1*p* and V2*p*, respectively, to obtain weighted voltages, and combines the weighted voltages together to obtain combined data. The weighting circuit 46 generates, at the node N10*b*, a current corresponding to the combined data. The determination circuit 48 compares the current at the node N10*a* and the current at the current node N10*b*, thereby determining whether the level of a voltage corresponding to the interpolation data item is high or low.

The current source 62 and the transistor 61 are used as the weighting circuit 46. The latch circuit 60 that is coupled in series with the transistor 61 between the ground and the power supply Vdd is used as the determination circuit 48. The weighting circuit 46 and the determination circuit 48 may have other circuit configurations.

For example, a load may be coupled between each of the nodes N10*a* and N10*b* and the power supply Vdd. In addition to the loads, a determination circuit that compares the potential at the node N10*a* and the potential at the node N10*b* may be provided.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An interpolation circuit comprising:

a plurality of holding circuits each configured to hold, using respective capacitors, corresponding input data that are inputted chronologically; and a generating circuit configured to generate interpolation data by performing a weighting operation on at least two pieces of the input data, which are chronologically adjacent to each other and are outputted by the plurality of holding circuits, based on an interpolation code that is used for generating interpolation data from the at least two pieces of the input data and combining weighted data of the at least two pieces of the input data.

2. The interpolation circuit according to claim 1, wherein charge corresponding to a voltage the input data is accumulated in the respective capacitors.

3. The interpolation circuit according to claim 1, wherein each of the plurality of holding circuits is configured to include:

a first switch coupled in series between one of two terminals of the respective capacitors and a first power supply;

a second switch coupled in series between the other terminal of the respective capacitors and a second power supply configured to supply a voltage lower than a voltage of the first power supply; and a third switch configured to apply, to the one of two terminals of the respective capacitors, a current corresponding to the input data.

4. The interpolation circuit according to claim 1, wherein the interpolation code is generated by comparing the interpolation data with a reference value and detecting a phase of a comparison result.

5. The interpolation circuit according to claim 1, wherein the generating circuit includes:

a weighting circuit configured to generate a current by assigning weights, based on the interpolation code, to the at least two pieces of the input data and combining the weighted data together; and a determination circuit configured to determine the interpolation data based on the current.

6. The interpolation circuit according to claim 3, wherein a time period for which the third switch is turned on is included in a time period for which the first switch is turned off and for which the second switch is turned on.

7. The interpolation circuit according to claim 5, wherein the weighting circuit generates a first current by assigning weights, based on the interpolation code, to the at least two pieces of the input data and combining the weighted data together, and generates a second current by assigning weights, based on the interpolation code, to inverted data of the at least two pieces of the input data and combining the weighted inverted data together, and wherein the determination circuit performs determination of the interpolation data by comparing the first current and the second current.

8. The interpolation circuit according to claim 2, wherein capacitance values of the respective capacitors are substantially the same.

9. A receiving circuit comprising:

an interpolation circuit configured to generate interpolation data; and a detection circuit configured to detect a phase of the interpolation data, and generate an interpolation code, wherein the interpolation circuit is configured to include:

a plurality of holding circuits each configured to hold, using respective capacitors, corresponding input data that are inputted chronologically; and a generating circuit configured to generate the interpolation data by performing a weighting operation on at least two pieces of the input data, which are chronologically adjacent to each other and are outputted by the plurality of holding circuits, based on the interpolation code that is used for generating the interpolation data from the at least two pieces of the input data and combining the weighted data of the at least two pieces of the input data.

10. The receiving circuit according to claim 9, wherein charge corresponding to a voltage of the input data is accumulated in the respective capacitors.

11. The receiving circuit according to claim 9, wherein each of the plurality of holding circuits is configured to include:

a first switch coupled in series between one of two terminals of the respective capacitors and a first power supply;

a second switch coupled in series between the other terminal of the respective capacitors and a second power supply configured to supply a voltage lower than a voltage of the first power supply; and a third switch configured to apply, to the one of two terminals of the respective capacitors, a current corresponding to the input data.

12. The receiving circuit according to claim 9, further comprising:

a determination circuit configured to compare the interpolation data with a reference value and output a comparison result to the detection circuit.

13. The receiving circuit according to claim 9, wherein the generating circuit is configured to include:

a weighting circuit configured to generate a current by assigning weights, based on the interpolation code, to the at least two pieces of the input data and combining the weighted data of the at least two pieces of the input data; and a determination circuit configured to determine the interpolation data based on the current.

14. The receiving circuit according to claim 11, wherein a time period for which the third switch is turned on is included in a time period for which the first switch is turned off and for which the second switch is turned on.

15. The receiving circuit according to claim 13, wherein the weighting circuit is configured to generate a first current by assigning weights, based on the interpolation code, to the at least two pieces of the input data and combining the weighted data of the at least two pieces of the input data, and generates a second current by assigning weights, based on the interpolation code, to inverted data of the at least two pieces of the input data and combining weighted inverted data of the at least two pieces of the input data, and wherein the determination circuit is configured to determine the interpolation data by comparing the first current and the second current.

16. The receiving circuit according to claim 10, wherein capacitance values of the respective capacitors are substantially the same.

* * * * *